United States Patent [19]

Bishop

[11] Patent Number: 4,750,840

[45] Date of Patent: Jun. 14, 1988

[54] MANUALLY OPERATED PORTABLE MIXING DEVICE

[76] Inventor: Robert J. Bishop, 1083 Bloomfield Ave., West Caldwell, N.J. 07006

[21] Appl. No.: 44,354

[22] Filed: Apr. 30, 1987

[51] Int. Cl.[4] ..... B28C 5/18

[52] U.S. Cl. ..... 366/54; 366/47

[58] Field of Search ..... 366/47, 54, 62, 63, 366/56, 57, 60, 185, 189, 45, 48, 55, 220, 228, 233

[56] References Cited

U.S. PATENT DOCUMENTS

| | | | |
|---|---|---|---|
| 4,197,015 | 4/1980 | Moser | 366/63 |
| 4,223,997 | 9/1980 | Violet | 366/47 |
| 4,357,109 | 11/1982 | Blakeway | 366/63 |
| 4,435,082 | 3/1984 | Bishop | 366/47 |
| 4,491,415 | 1/1985 | Bishop | 366/63 |
| 4,634,284 | 1/1987 | Bishop | 366/63 |

*Primary Examiner*—Robert W. Jenkins

*Attorney, Agent, or Firm*—Howard E. Thompson, Jr.

[57] ABSTRACT

A manually operated portable mixing device is provided in which a frame of knockdown construction provides means for rotatably supporting a mixing drum of centrally expanded cylindrical contour in a manner to dispose the drum axis at an angle of about 20 degrees with respect to a support surface, the drum having a large circular opening at one end and being closed at the opposed end, roller means at the rear of the frame engaging an annular groove on an axially protruding bearing member at the closed end of the drum, roller means at the front of the frame engaging outer surfaces of the drum adjacent the open end thereof, a three-sided frame extension of a size to be closely spaced from the periphery of the rotatably supported open drum end, the lower rear portion of the frame detachably supporting wheels in a manner to be slightly elevated with respect to a support surface, and the drum at the centrally expanded portion thereof, having four detachably mounted and radially extended hand-grip members at 90° intervals circumferially of the drum, the hand-grip members serving the multiple functions of providing means for easily rotating the drum in mixing operations, for rearwardly tilting the assemblage to move it about on said wheels, and for forwardly tilting the assemblage and rotating the drum to facilitate the discharge of mixed contents.

11 Claims, 2 Drawing Sheets

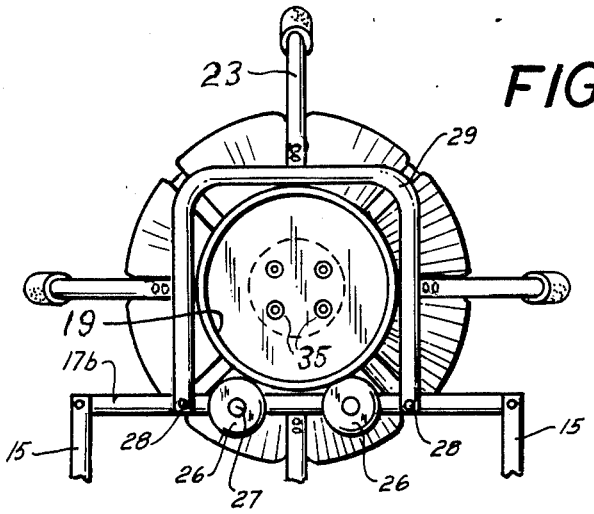
FIG. 3
FIG. 4
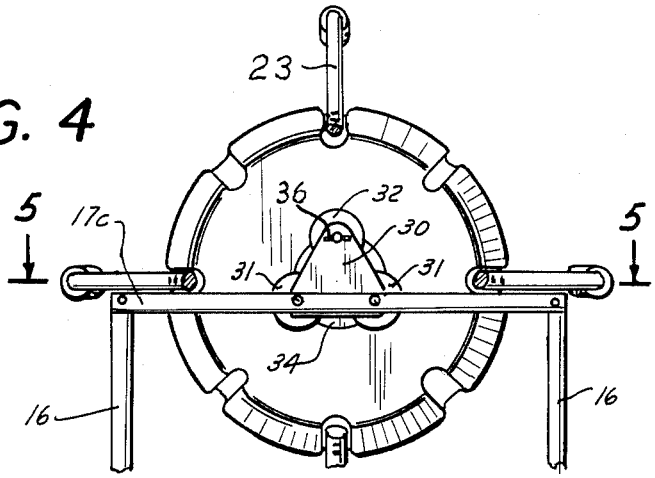
FIG. 5
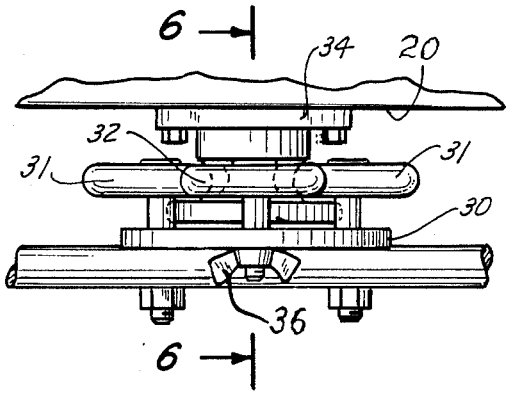
FIG. 6
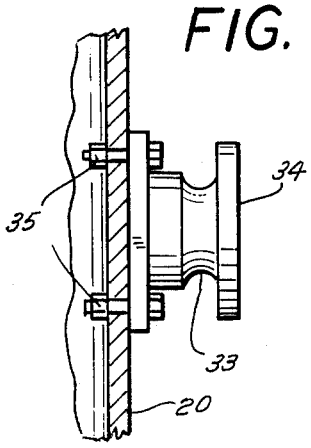

MANUALLY OPERATED PORTABLE MIXING DEVICE

This invention relates to a manually operated portable mixing device intended to meet the needs of home owners, small farmers, and the like having infrequent occasions to conduct mixing operations, and for whom the quantities of components to be mixed and the location at which mixing may be desired make unnecessary the reliance on any electrical or other mechanical drive means.

BACKGROUND OF THE INVENTION

The problems involved in preparing uniform blends of different components, including in particular the problems of preparing uniform solid-liquid blends as in the mixing of cement and concrete, have so long been with us that the art of rotary drum mixing devices is probably one of the oldest of the mechanical arts. Advancements in this art have not kept up, however, with the unique needs of substantial groups of individuals such as the do-it-yourself home owner, the small farmer and the like, for whom occasions of mixing operations may be infrequent and the locations widely varied.

Approaches to meeting these needs have been presented in my U.S. Pats. Nos. 4,491,415 issued Jan. 1, 1985 and 4,435,082 issued May 6, 1984, and pending application Ser. No. 783,680 filed Oct. 3, 1985, now U.S. Pat. No. 4,634,284 issued Jan. 6, 1987. In addition, improvements in mixing drum construction have been disclosed in my co-pending application Ser. No. 930,453 filed Nov. 14, 1986 as a continuation-in-part of earlier application, Ser. No. 783,681 filed Oct. 3, 1985. While these innovations provide important benefits to users of the type described, they do not provide the unique combination of simplicity, ease of operation, and particularly the ease of portability provided by the novel structure of the present invention.

THE INVENTION

In accordance with the present invention a Manually Operated Portable Mixing Device is provided in which a frame of knockdown construction having similar tubular side members, deformed to provide parallel front and rear portions, and intermediate angularly disposed base and tilt support portions, transverse tubular connecting members detachably joining the side members at upper ends of the front and rear portions and at approximately the mid-points of the base portions, roller means on the front and rear connecting members for rotatably supporting a mixing drum of centrally expanded cylindrical contour in a manner to dispose the drum axis at an angle of about 20 degrees with respect to the base portions, the drum having a large circular opening at one end and being closed at the opposed end, the roller means on the rear connecting member engagin an annular groove on an axially protruding bearing member at the closed end of the drum, the roller means on the front connecting member engaging outer surfaces of the drum adjacent the open end thereof, the forward connecting member also detachably supporting a three-sided frame member oriented in the plane of front portions of the side members, and of a size to be closely spaced from the periphery of the rotatably supported open drum end, the side members providing support, at the juncture of the rear and bottom portions thereof, for detachable rearwardly extending brackets supporting wheels in a manner to be slightly elevated with respect to a support surface engaged by the bottom members of the frame, and the drum at the centrally expanded portion thereof, having four detachably mouned and radially extended hand grip members at 90° intervals circumferially of the drum, the hand-grip members serving the multiple functions of providing means for easily rotating the drum in mixing operations, for rearwardly tilting the assemblage to move it about on said wheels, and for forwardly tilting the assemblage and rotating the drum to facilitate the discharge of mixed contents.

The drum can be a unitary molded body of generally "pear shaped" configuration, or a composite of two nestable frustoconical members sealably joined at the larger diameter thereof, as disclosed in said copending application Ser. No. 930,453 filed Nov. 14, 1986. The latter construction provides the special advantage of substantially reducing the size of the container needed for storage and shipping of the device in its knockdown form.

The drum, whether in unitary or multi-component form above described, is suitably fashioned from polyethylene or other moldable plastic material with inwardly offset and axially extending stiffening and mixing ribs at uniformly spaced intervals circumferentially of the drum. Because these ribs provide a means for properly aligning the four hand-grip members it is appropriate, depending on the size of the drum, to emply 4, 8 or 12 circumferentially spaced ribs. It is also desirable that the bolts or other fasteners employed for attaching the handgrip members and the axial hub to the plastic drum body be likewise fashioned from plastic material. In this way the drum can be approved for use in the mixing of food products as, for example, in restaurants, bakeries, and other food handling establishments.

The simplicity and economy of the structure is enhanced by the fact that the basic frame is made up of two components, a side frame component of which two are used and a connecting member of which three are used. Each connecting member is provided with eight transverse holes, two at the end thereof for attachment to the side members and three sets of holes appropriately spaced from the mid-point of the connecting member. The two outer sets of holes are utilized when the connecting member is used at the front of the assemblage, the inner set of holes is used when the connecting member is at the rear of the assemblage and the presence of the intermediate holes in no way interferes with the effectiveness of the connecting member in joining base portions of the side frames.

The simplicity and economy of the device is further enhanced by employing a single roller structure for use with the two rollers secured to the front connecting member and the three rollers carried by the rear connecting member. At the front of the device these rollers are directly attached to the front connecting member to be oriented in a plane parallel to the plane of the front portions of the side frame parts. At the rear of the device two rollers and two corners of a triangular extension plate are collectively joined to the connecting member in a manner to dispose the extensive plate in a plane parallel to the plane of the rear portions of the side frame parts. The third roller at the rear of the assemblage is secured to the upwardly extending corner at the extension plate by readily detachable means such as a bolt and wing-nut. When this third roller is in place, the rear rollers collectively engage an annular groove in the axial hub serving to support the drum against axial movement during mixing and dumping operations. It will be noted, however, that when it is desired to deliver mixed drum contents to a point of use remote from the assemblage, this can be accomplished by disengaging the wing-nut, removing the third rear roller and lifting the drum from the assemblage.

The type and arrangement of hand-grip members further enhances the efficiency and practical utility of the assemblage. They provide for easy manual rotation of the drum in various mixing operations, including the mixing operations if the drum is filled to capacity with the solid and liquid components for cement or concrete. The spacing of the hand-grip members is such as to provide a comfortable and convenient means for rearwardly tilting the assemblage and moving it about on the wheels in which operation the center of gravity of the drum is essentially in vertical alignment with the wheels. The placing of the hand-grip members also facilitates easy tilting of the assemblage forwardly to rest upon tilt-support portions of the side frames for discharge of the contents of the drum while rotating the drum to facilitate such discharge.

Novel features of the manually operated Portable Mixing device of the present invention will be more readily understood from a consideration of the following description having reference to the accompanying drawings, in which various parts of the device are identified by suitable reference characters in the several views, and in which:

FIG. 3 is a fragmentary view of the open end of the device taken substantially along the linek 3—3 of FIG. 2.

FIG. 4 is a fragmentary view of the closed end of the device taken substantially along the line 4—4 of FIG. 2.

FIG. 5 is a fragmentary view of the rotary support mechanism shown in FIG. 4 taken in the direction of the arrows 5—5, and FIG. 6 is an enlarged detail view of the rotary support hub taken substantially on the line 6—6 of FIG. 5.

Figure 1:
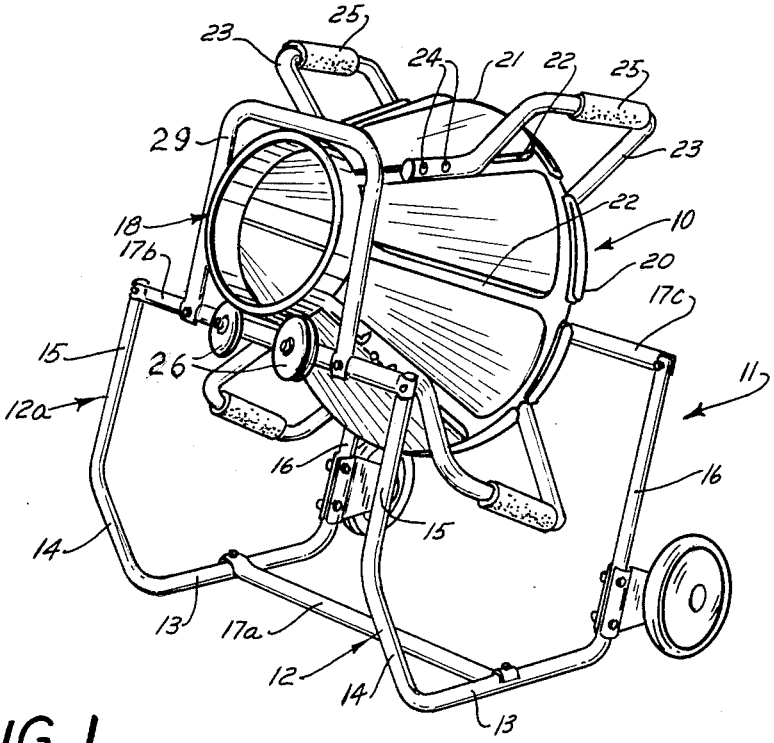
FIG. 1 is a perspective view of the device seen as resting on a support surface in its mixing orientation.

As shown in the drawing the hand-operated portable mixing device comprises a mixing drum 10 detachably and rotatably supported in a frame 11 comprising a plurality of readily assembled and disassembled parts, permitting the entire device, when disassembled, to be packaged in a container for which the size is dictated by the size of the drum 10.

The frame 11 comprises a pair of identical side members 12, 12*a* suitably fashioned from metal tubing and contoured to provide base portions 13, angularly disposed tilt portions 14 and parallel front portions 15 and rear portions 16, the side members 12, 12*a* being joined by three identical cross members, 17*a* joining the base portions 13; 17*b* joining the upper ends of the front portions 15; and 17*c* joining the upper ends of the rear portions 16.

The drum 10, which is suitably fashioned from polyethylene or other molded plastic material, has an open end 18 bounded by a short cylindrical portions 19, a closed end 20 and an enlarged diameter mid-section 21 providing the desired volume for mixing components in rotation of the drum. The drum is provided with a plurality of inwardly offset and circumferentially spaced stiffening and mixing ribs 22.

The drum is provided with four hand-grip members 23 at 90° intervals circumferentially of the drum shaped to interfit with the ribs 22, and being detachably mounted to the drum by means of bolts 24. Cross head portions of the hand-grip members 23 are suitably provided with rotatable sleeves 25 to facilitate comfortable gripping in the manual rotation of the drum when mixing contents. It will be noted that the drum as illustrated is provided with 8 ribs 22. This number can be reduced to 4 in a smaller adaptation of the invention or, if desired, increased to 12 in a larger adaptation of the invention.

As more clearly shown in FIG. 3 the front connecting member 17*b* carries rollers 26 detachably mounted by means of bolts 27 and spaced to rotatably engage the cylindrical portion 19 of the open end of the drum. Also detachably secured to connecting member 17*b* by means of bolts 28 is an upstanding U-shaped member 29 contoured to be closely spaced from the periphery of the cylindrical portion 19. The U-shaped member 29 functions as a restraining guide to prevent accidental disengagement of the drum and frame during dumping operations.

As clearly shown in FIGS. 4 and 5 the rear connecting member 17*c* is provided centrally thereof with a triangular and upwardly extending plate 30 providing orientation and support for two fixed rollers 31 spaced longitudinally of the connecting member 17*c* and a third roller 32 equally spaced from and above rollers 31. The three rollers engage an annular groove 33 in a hub 34 secured to the closed end 20 of the drum by means of bolts 35, as illustrated in FIG. 6.

The engagement of the rollers 31, 32 with the groove 33 in hub 34 serves to position and restrain the drum in the frame during both mixing and dumping operations. It will be noted, however, that the upper roller 32 is secured to the triangular extension 30 by means of a bolt provided with wing-nut 36 facilitating easy detachment of roller 32 to permit lifting of the drum and contents from the frame. This feature can be desirable in instances where it is desired to deliver mixed drum contents to locations remote from the frame support.

Figure 2:
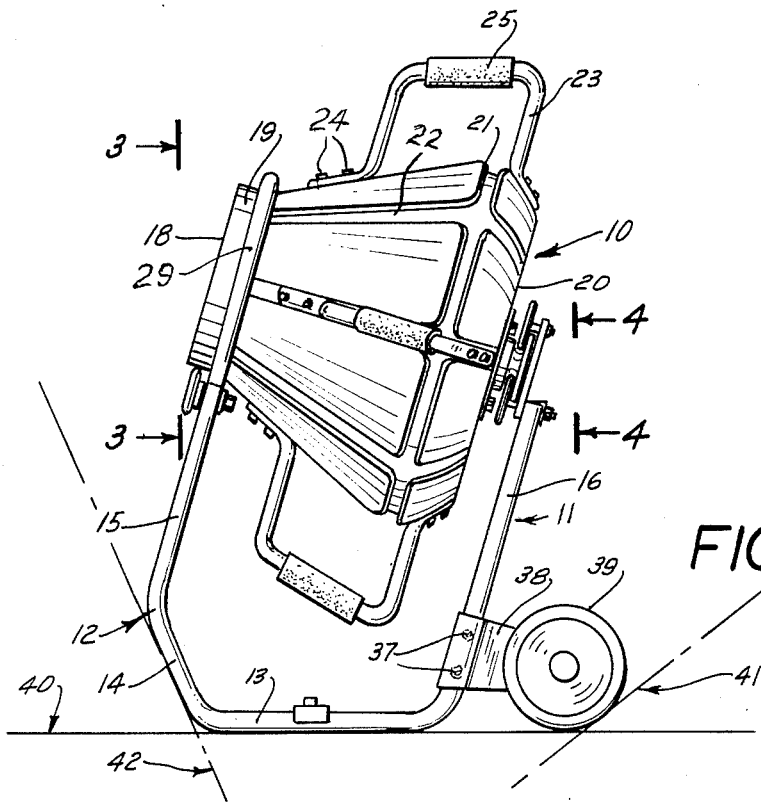
FIG. 2 is a side elevation view of the device shown in FIG. 1 with reference lines indicating the orientation of support surfaces when in mixing orientation, dumping orientation and moving orientation.

As clearly shown in FIG. 2 of the drawing the drum 10, in the mixing orientation, is supported in a manner to elevate the open end 18 with the drum axis at an angle of about 20° with respect to the supporting surface. This is accomplished by rearwardly inclining the front and rear portions 15 and 16 of the frame members 12, 12*a* and appropriately positioning the front and rear connecting members 17*b* and 17*c*. The parallel planes defined by the frame front members 15 and rear members 16 should be substantially perpendicular to the drum axis, as shown.

At the lower portions on the rear frame members 16 and secured by bolts 37 are essentially triangular extension plates 38 carrying wheels 39. The wheels 39 are so positioned that when the device is resting on support surface 40 in its mixing configuration the wheels will barely touch, or be slightly above, such support surface. When it is desired to move the assemblage about the operator will grasp two of the drum handgrips 25 and tilt the assemblage rearwardly to be supported by the wheels 39. This moving configuration can be visualized by rotating FIG. 2 so that the dot-dash line 41, representing the support surface when moving the device, is in the horizontal position. In this configuration it will be seen that the center of gravity of the drum will be directly above the wheels 39.

When drum contents have been suitably mixed by hand-rotation of the drum, the dumping of contents is easily accomplished by forwardly tilting the assemblage so that the tilt portions 14 rest on the support surface 42 as shown in the dot-dash lines in FIG. 2. In this configuration it will be apparent that drum contents will be freely discharged, and that substantially complete discharge can be accomplished by manual rotation of the drum while in this configuration.

As will be seen in the drawing the hand-grips 25 are angled slightly with respect to the drum axis to be convergent in the direction of the open end of the drum to thereby dispose hand-grip portions 25 substantially parallel to the ground or other support surface when in the upwardly extended position as shown in FIG. 2. This inclined orientation of the hand-grips 25 provides comfort to the operator during mixing operation and at the same time disposes adjacent hand-grips 25 in the slightly divergent relation, comparable to that of wheel barrow handles with respect to an operator who has tilted the assemblage to move it about on the wheels 39. The angular orientation of the hand-grips 25 is also practical and comfortable for the operator, when the assemblage is tilted forward on the tilt portions 14 and the drum is being rotated or oscillated to aid in discharge of contents therefrom.

In a practical general purpose mixing device of the type described in the mixing drum will suitably have an axial dimension of approximately 20 inches and maximum diameter of about 23 to 24 inches. Such a size is well suited for the average home owner and the small farmer in operations such as cement mixing, animal feed mixing, and preparing soil mixtures for potting, etc.

The structure also lends itself by reason of the plastic drum construction and utilizing plastic bolts and fasteners in the assemblage, to the mixing of food products, as for example, the blending of coffees, teas and the like, and the mixing of ingredients by bakers and other food handlers. In such diverse uses it will be understood that substantially larger or smaller drum sizes may be desirable; and it will be apparent that the relative sizes of all frame parts will be appropriately decreased or increased to accommodate the desired drum size.

Various changes and modifications in the manually operated portable mixing device as herein described may occur to those skilled in the art; and to the extent that such changes and modifications are embraced by the appended claims, it is to be understood that they constitute part of the present invention.

I claim:

1. A manually operated portable mixing device comprising a mixing drum of centrally expanded cylindrical contour rotatably supported in a frame of knockdown construction, said frame having similar tubular side members, deformed to provide parallel front and rear portions, and intermediate angularly disposed base and tilt support portions, transverse tubular connecting members detachably joining the side members at upper end of the front and rear portions and at approximately the mid-points of the base portions, roller means on the front and rear connecting members for rotatably supporting said mixing drum in a manner to dispose the drum axis at an angle of about 20 degrees with respect to the base portions, the drum having a large circular opening at one end and being closed at the the opposed end, the roller means on the rear connecting member engaging an annular groove on an axially protruding bearing member at the closed end of the drum, the roller means on the front connecting member engaging outer surfaces of the drum adjacent the open end thereof, the forward connecting member also detachably supporting a three-sided frame member oriented in the plane of front portions of the side members, and of a size to be closely spaced from the periphery of the rotatably supported open drum end, the side members providing support, at the juncture of the rear and bottom portions thereof, for detachable rearwardly extending brackets supporting wheels in a manner to be slightly elevated with respect to a support surface engaged by the bottom members of the frame, and the drum at the centrally expanded portion thereof, having four detachably mounted and radially extended hand-grip members serving the multiple functions of providing means for easily rotating the drum in mixing operations, for rearwardly tilting the assemblage to move it about on said wheels, and for forwardly tilting the assemblage and rotating the drums to facilitate the discharge of mixed contents.

2. A manually operated portable mixing device as defined in claim 1 wherein the roller means on the rear connecting member are secured at corner portions of a triangular extension plate having one side secured to said rear connecting member in a manner to dispose said triangular plate in a plane parallel to the plane of said rear portions of the side members, the mounting of said triangular plate to said rear connecting member also providing support for two rollers, and a third roller being detachably secured to the upwardly extending corner of said triangular plate.

3. A manually operated portable mixing device as defined in claim 1 wherein the roller means on the front connecting member comprises two rollers secured directly to said front connnecting member in a manner to dispose said rollers in a plane parallel to the plane of said front portions of the side members, and said rollers being spaced apart by a distance slightly less than the radius of the engaged drum and thereby providing a minimum clearance between said front connecting member and the supported drum end.

4. A manually operated portable mixing device as defined in claim 1 wherein said hand-grip members comprise deformed tubular elements of general U-shaped configuration providing a central hand-gripping portion, parallel portions protruding therefrom, and said parallel portions terminating in angularly disposed portions of appropriate angularity to facilitate clamping engagement with forward and rear portions of the drum.

5. A manually operated portable mixing device as defined in claim 4 wherein the forward of said parallel protruding portions of the tubular element is slightly shorter to thereby dispose the hand-gripping portion of said element at a slightly and forwardly inclined angle with respect to the axis of said drum.

6. A manually operated portable mixing device as defined in claim 4 wherein the hand-gripping portion of said deformed tubular element carries a cylindrical sleeve closely and rotatably engaging said hand-gripping portion.

7. In a manually operated portable mixing device comprising a mixing drum of centrally expanded cylindrical contour rotatably supported in a frame of knockdown construction, a mixing drum of molded plastic construction having axially spaced open and closed ends and an enlarged diameter portion between said ends, said closed end having secured thereto an axially protruding hub having an annular, roller-engaging groove, said open end having an annular, roller engaging band of cylindrical contour, said drum having four inwardly offset stiffening and mixing ribs extending axially of the drum and uniformly spaced circumferentially of the drum, and said drum having four generally U-shaped hand grip members with angularly offset ends aligning with and detachably secured in said ribs to dispose the hand grip members radially of the drum with the hand gripping portions extending axially of the drum.

8. A mixing drum as defined in claim 7 wherein the hand gripping portions of said hand grip members are disposed at angles with respect to the drum axis that are slightly convergent in the direction of the open end of the drum.

9. A mixing drum as defined in claim 7 wherein the drum may contain 4, 8 or 12 inwardly offset stiffening and mixing ribs uniformly spaced circumferentially of the drum, and said hand grip members are mounted in four of said ribs which are spaced 90° from each other.

10. In a manually operated portable mixing device comprising a mixing drum rotatably supported in a frame of knockdown construction, a knockdown frame structure made up of two indentical tubular side frame members deformed to provide parallel front and rear portions joined by angularly disposed base and tilt support portions, three identical tubular connecting members, means for coupling a connecting member with said side frame members at the upper ends of said front frame portion, at the upper end of said rear frame portion, and at approximately the mid-points of said base portions, said front connecting member detachably supporting spaced rollers and a U-shaped tubular extension in planes parallel to the plane of said front frame portions, said rear connecting member detachably supporting a central triangular extension plate having equispaced rollers at the corners thereof in planes parallel to the plane of said rear frame portions, and said side frame members having detachably secured to the rear frame portions thereof, rearwardly extending plates supporting wheels disposed in planes parallel to the planes of said side frame members, and at an elevation to be closely spaced from a support surface engaged by the base portions of said frame.

11. A knockdown frame structure as defined in claim 10, wherein the three rollers carried by said rear connecting member are adapted for interlocking engagement with an annular groove on a bearing portion of a supported drum, two of the three rollers are spaced longitudinally of said member, and the third roller is secured to said extension plate by quickly detachable means, facilitating easy engagement and disengagement of a mixing drum with said frame.

* * * * *